US008237643B2

(12) United States Patent
Wu et al.

(10) Patent No.: US 8,237,643 B2
(45) Date of Patent: Aug. 7, 2012

(54) TRANSREFLECTIVE DISPLAY APPARATUS AND DRIVING METHOD THEREOF

(75) Inventors: Biing-Seng Wu, Tainan County (TW); Lin-Kai Bu, Tainan County (TW); Ying-Lieh Chen, Tainan County (TW)

(73) Assignee: Himax Technologies Limited, Tainan (TW)

( * ) Notice: Subject to any disclaimer, the term of this patent is extended or adjusted under 35 U.S.C. 154(b) by 866 days.

(21) Appl. No.: 12/269,483

(22) Filed: Nov. 12, 2008

(65) Prior Publication Data

US 2010/0117940 A1 May 13, 2010

(51) Int. Cl.
*G09G 3/34* (2006.01)

(52) U.S. Cl. ..... 345/84; 345/85; 345/86

(58) Field of Classification Search ..... 345/1.3, 345/55, 84–103, 204, 211, 212, 581, 589, 345/694–696; 700/21, 22, 79, 295; 455/1, 455/73, 99, 566

See application file for complete search history.

(56) References Cited

U.S. PATENT DOCUMENTS 6,750,834 B2 * 6/2004 Shen ..... 345/87
6,801,811 B2 * 10/2004 Ranganathan et al. ..... 700/22
6,850,209 B2 * 2/2005 Mankins et al. ..... 345/1.3
7,388,181 B2 * 6/2008 Han et al. ..... 250/205
7,636,076 B2 * 12/2009 Hung et al. ..... 345/88
7,643,115 B2 * 1/2010 Sato et al. ..... 349/114
7,710,388 B2 * 5/2010 Hirata et al. ..... 345/103
7,855,706 B2 * 12/2010 Ozawa ..... 345/89
8,072,473 B2 * 12/2011 Kim et al. ..... 345/690
2002/0164962 A1 * 11/2002 Mankins et al. ..... 455/99
2002/0180681 A1 * 12/2002 Shen ..... 345/94
2003/0135288 A1 * 7/2003 Ranganathan et al. ..... 700/22
2005/0168423 A1 * 8/2005 Hirata et al. ..... 345/88
2006/0022934 A1 * 2/2006 Whitted et al. ..... 345/102
2006/0109233 A1 * 5/2006 Lee et al. ..... 345/102
2006/0232579 A1 * 10/2006 Chen et al. ..... 345/211
2007/0013628 A1 * 1/2007 Kim et al. ..... 345/89
2007/0063945 A1 * 3/2007 Hung et al. ..... 345/88
2007/0101384 A1 * 5/2007 Han et al. ..... 725/106
2008/0079679 A1 * 4/2008 Ozawa ..... 345/89
2008/0094554 A1 * 4/2008 Sato et al. ..... 349/114
2008/0165309 A1 * 7/2008 Ge et al. ..... 349/85
2008/0266331 A1 * 10/2008 Chen et al. ..... 345/690
2008/0297451 A1 * 12/2008 Marcu ..... 345/77
2009/0040432 A1 * 2/2009 Lu et al. ..... 349/68
2010/0085289 A1 * 4/2010 Munteanu et al. ..... 345/88

* cited by examiner

*Primary Examiner* — Prabodh M Dharia
(74) *Attorney, Agent, or Firm* — J.C. Patents

(57) ABSTRACT

A driving method and a transreflective display apparatus are provided herein. In the driving method, a plurality of voltage-to-transparency curves are provided. An ambient light intensity of the display apparatus is detected for determining a display mode, wherein the display mode is either a transmissive mode or a reflective mode. Next, one of the voltage-to-transparency curves is selected according to the display mode and the ambient light intensity for driving the display apparatus. Therefore, by referring a proper voltage-to-transparency curve to drive the display apparatus, the display quality of the display apparatus can be enhanced.

16 Claims, 4 Drawing Sheets

TRANSREFLECTIVE DISPLAY APPARATUS AND DRIVING METHOD THEREOF

BACKGROUND OF THE INVENTION

1. Field of Invention

The present invention relates to a display apparatus, and, in particularly, relates to a transreflective display apparatus and driving method thereof.

2. Description of Related Art

There are more and more electronic devices have display devices, such as cell phones, personal digital assistants (PDAs), and laptop computers. The display devices are requested to be thin and/or light in order to save the volume and the cost of the electronic devices. To satisfy these requirements, various flat panel displays (FPDs) have been developed as alternatives to more conventional cathode ray tube displays.

The display panels of the FPDs are classified as transmissive display panels, reflective display panels, and transreflective display panels. The transmissive display panel uses a backlight module disposed at the back thereof to serve as a light source. The reflective display panel uses ambient light or a light source in the front of the panel. The transreflective display panel can use a backlight module and/or the ambient light as the light source.

FIG. 1 illustrates a diagram of a transreflective display panel. Each pixel of the transreflective display panel includes a reflective area, made of reflective material, and a transmissive area, made of transparent material. When the ambient light intensity around the display panel is strong enough, e.g. higher than a threshold value, the display panel is in a reflective mode that the ambient light is used as the light source and the display panel emanates lights from the reflective area. When the ambient light intensity is not strong, the display panel is in a transmissive mode that the backlight module is used as the light source and the display panel emanates lights from the transmissive area.

However, while the transreflective display panel is in the transmissive mode, the backlight module is started to provide a backlight, but the ambient light still exists to be reflected from the reflective area. Hence, some gray levels representing the darker pixels can not be displayed distinguishably. FIG. 2 shows a voltage-to-transparency (V-T) curve of the transreflective display panel. The dashed line L' shows the distorted V-T curve, compared to the original solid line L without distortion. That is, while the voltage V0 is applied to the pixel, transparency T0' of the distorted V-T curve L' is actually displayed, instead of the expected transparency T0 in the original V-T curve L, due to the reflected ambient light. Therefore, the low gray levels corresponding below the transparency T0' can not be distinguishably displayed as dark as desired. Therefore, it needs a good driving method for improving the above problems and further providing other advantages.

SUMMARY OF THE INVENTION

The present invention provides a driving method for a transreflective display apparatus which has a dual mode display panel. By this driving method, images can be displayed normally both in a reflective mode and in a transmissive mode, and the display quality of the display apparatus can be enhanced. In addition, the present invention also provides a transreflective display apparatus having the said advantages.

A driving method for a transreflective display apparatus is provided in the present invention. In the driving method, an ambient light intensity of the display apparatus is detected for determining a display mode of the display apparatus. If the ambient light intensity is greater than a predetermined value, the display mode is set to a reflective mode, else the display mode is set to a transmissive mode. Then, one of a plurality of voltage-to-transparency curves is selected according to the display mode and the ambient light intensity for driving the display apparatus.

In an embodiment of the foregoing driving method, the V-T curves include a transmissive mode V-T curve and a reflective mode V-T curve. If the display mode is the transmissive mode, and there exists some ambient light affecting the display quality (or the ambient light intensity is larger than a low threshold), the transmissive mode V-T curve is selected.

A transreflective display apparatus is provided in the present invention. The display apparatus includes a display panel, an ambient light detector, a backlight module, a timing controller and a gamma voltage generator. The display panel having dual display mode is used for display an image. The ambient light detector detects an ambient light intensity of the display apparatus, and thereby determines a display mode of the display apparatus according to the ambient light intensity, wherein the display mode is either a transmissive mode or a reflective mode. The backlight module provides a backlight when the display mode is the transmissive mode. The timing controller selects one of a plurality of voltage-to-transparency (V-T) curves according to the display mode and the ambient light intensity. Then, the timing controller controls the gamma voltage generator generates a plurality of gamma voltages according to the selected V-T curve.

In an embodiment of the foregoing display apparatus, the ambient light detector includes a photo sensor and a light controller. The photo sensor detects the ambient light intensity of the display apparatus to output an electronic signal. The light controller converts the electronic signal into a detection signal with digital form, such that the ambient light controller can determines the display mode according to the detection signal.

The present invention provides a driving method and a transreflective display apparatus that selects a proper voltage-to-transparency (V-T) curve to drive pixels on the display panel according to the ambient light intensity and the display mode. When the display apparatus is in the transmissive mode, the pixels having the lower gray levels can not be displayed distinguishably as a result of the existence of the ambient light. Hence, considering the influence of the ambient light, the V-T curves are designed for different display modes, even there are several V-T curves designed for the transmissive mode according to different ambient light intensity. Therefore, the display quality of the display apparatus can be enhanced by referring the proper voltage-to-transparency (V-T) curve.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
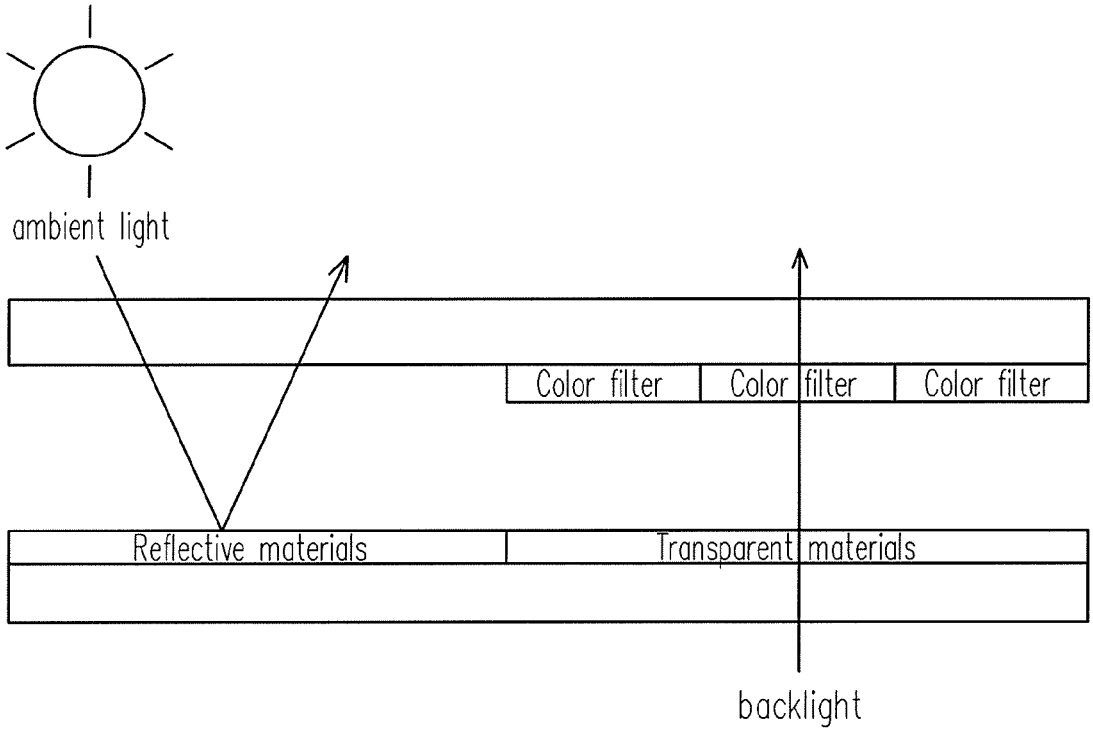
FIG. 1 (PRIOR ART)
FIG. 1 illustrates a diagram of a transreflective display panel.
Figure 2:
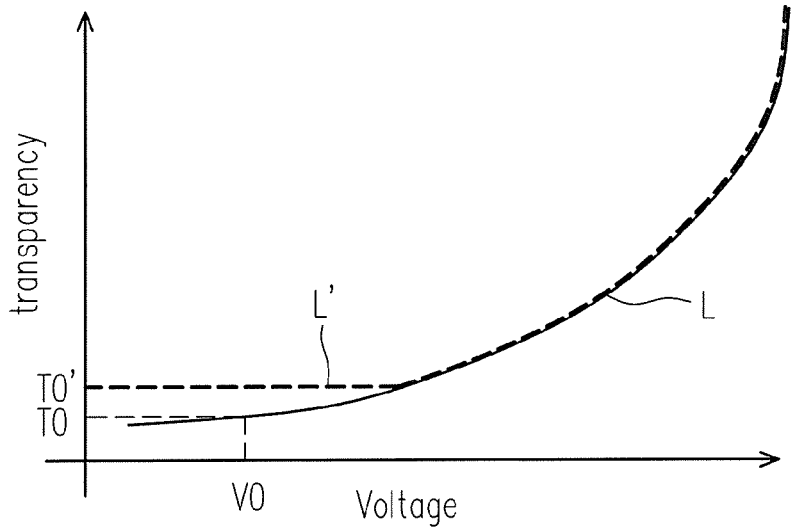
FIG. 2 (PRIOR ART)
FIG. 2 shows a voltage-to-transparency curve of the transreflective display panel.

Reference will now be made in detail to the present embodiments of the invention, examples of which are illustrated in the accompanying drawings. Wherever possible, the same reference numbers are used in the drawings and the description to refer to the same or like parts.

Figure 3A:
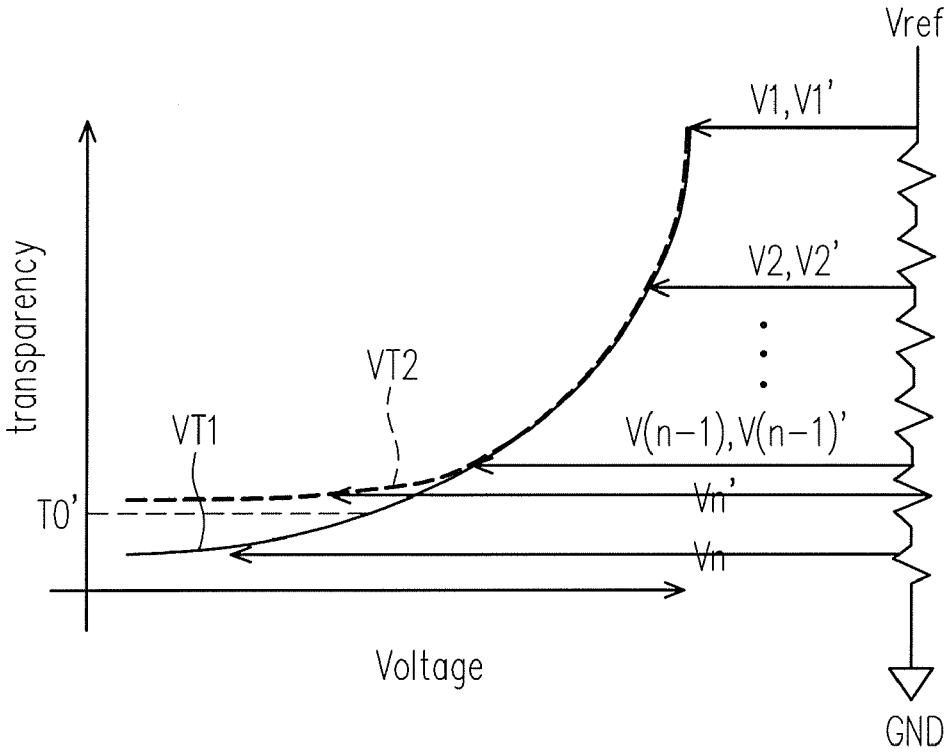
FIG. 3A shows two voltage-to-transparency curves for the display apparatus according to an embodiment of the present invention.

In embodiments of the invention, a transreflective display apparatus has a display panel and a backlight module serving as a light source, wherein the backlight module can emit light into the display panel. FIG. 3A shows two voltage-to-transparency (V-T) curves VT1 and VT2 for the display apparatus according to an embodiment of the present invention. The display apparatus provides two different V-T curves, VT1 and VT2, respectively for different display mode. Each V-T curve is determined by one set of gamma voltages, which are provided to the digital-to-analog converter of a source driver, such as the gamma voltages V1 through Vn in the first V-T curve VT1, and the gamma voltages V1' through Vn' in the second V-T curve VT2.

In order to distinguish the lower gray levels, one or more gamma voltages corresponding to the lower gray levels in the first V-T curve VT1 are different to those corresponding to the same gray levels in the second V-T curve VT2. In FIG. 3A, the gamma voltage Vn corresponding to the lowest gray level of the first V-T curve VT1 is different from the gamma voltage Vn' corresponding to the lowest gray level of the second V-T curve VT2. In other words, for displaying the lowest gray level, the gamma voltage Vn' provided by referring the second V-T curve VT2 is greater than the gamma voltage Vn provided by referring the first V-T curve VT1. In an alternative embodiment, it should be noted that the digital-to-analog converter may generate more additional gamma voltages by interpolating the received gamma voltages V1, V2, . . . and Vn/Vn', such that the lower gray levels corresponding between V(n−1) to Vn are different from the lower gray levels corresponding between V(n−1) to Vn'. The gamma voltages are generated by a resistor string for example. As shown in FIG. 3A, a terminal of a resistor string is coupled to a reference voltage Vref, and the other terminal of the resistor string is coupled to a ground voltage GND. According to the voltage division theorem, the resistor string can output several analog gamma voltages for driving the pixels on the display panel. Each of the gamma voltages drives the pixel at a corresponding transparency of the display panel. The first V-T curve VT1 is determined by the first set of the gamma voltages V1 through Vn; while the second V-T curve VT2 is determined by the second set of the gamma voltages V1' through Vn', wherein in the V-T curves VT1 and VT2, the same reference numbers affixed to the symbol "V", e.g. V1 and V1', V2 and V2', or Vn and Vn', correspond to the same gray level. In this embodiment, although only one gamma voltage corresponding to the lowest gray level (representing the darkest pixel) is different between the two V-T curves VT1 and VT2, in the alternative embodiments, more than one gamma voltages may be different between the two V-T curves VT1 and VT2.

Figure 3B:
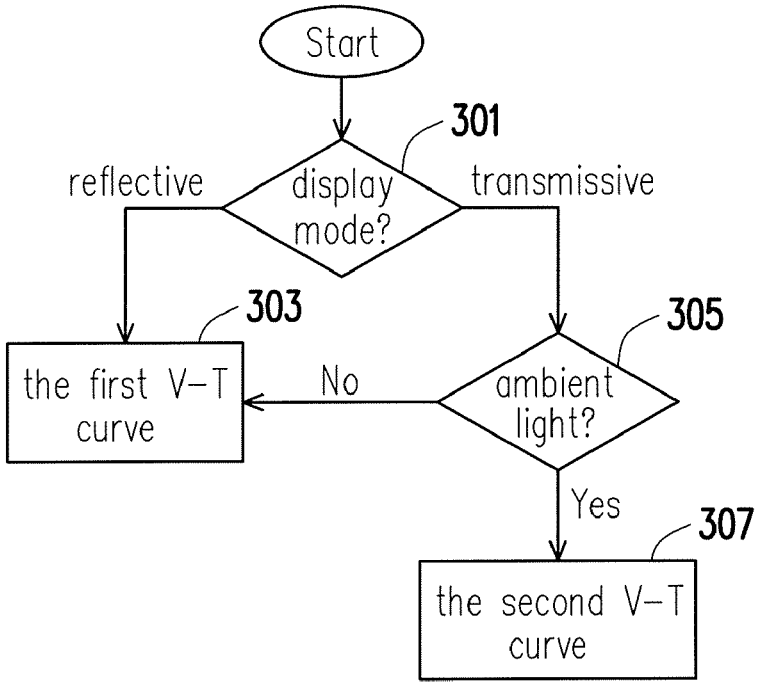
FIG. 3B illustrates a flow chart of a method for selecting the V-T curve according to an embodiment of the present invention.

In the embodiment of the present invention, the display apparatus selects one of the V-T curves according to the display mode and the intensity of the ambient light. FIG. 3B illustrate a flow chart of a method for selecting the V-T curve. First, in step 301, the display mode is determined, for example, by detecting the ambient light intensity. When the ambient light intensity is higher than a predetermined value, the display mode is set to the reflective mode, or else the display mode is set to the transmissive mode. In the reflective mode, the backlight module of the display apparatus is turned off, and the first V-T curve is applied for the digital-to-analog converter of the display apparatus to generate the proper gamma voltages. In the transmissive mode, the backlight module of the display apparatus is turned on.

In step 305, it is detected whether there is still some ambient light. If there is still some ambient light, the ambient light may cause the darker pixels, having lower gray levels, indistinguishable. Hence, the second V-T curve VT2 is applied for the display apparatus in step 307, else the first V-T curve VT1 is applied in step 303. In the embodiment of the present invention, the gamma voltages provided by referring the second V-T curve VT2 can drive the pixel at the transparencies which are above the critical transparency T0', and having small difference each other. In the transmissive mode with some ambient light, applying the second V-T curve VT2 can display the lower gray levels distinguishably. In other embodiment, the step 305 is optional, and the transmissive mode uses the second V-T curve regardless of the ambient light. Some ambient light is defined if the intensity of the ambient light is larger than a low threshold.

As the foregoing description, although the said embodiment provides two V-T curves VT1 and VT2 for enhancing the display quality of the display apparatus under different display modes, in consideration with the ambient light intensity, a plurality of V-T curves can be also designed when the display apparatus is in the transmissive mode. In other word, when the display apparatus is set to the transmissive mode, the critical transparency T0' is changed as the ambient light intensity, which results in that the pixels driven by the gamma voltages, lower than a certain gamma voltage driving the pixel at the critical transparency T0', are displayed indistinguishably. The more the ambient light is, the higher the critical transparency T0' is, and the more the lower gray levels are displayed indistinguishably. Hence, more appreciate V-T curves are required to design.

Figure 4:
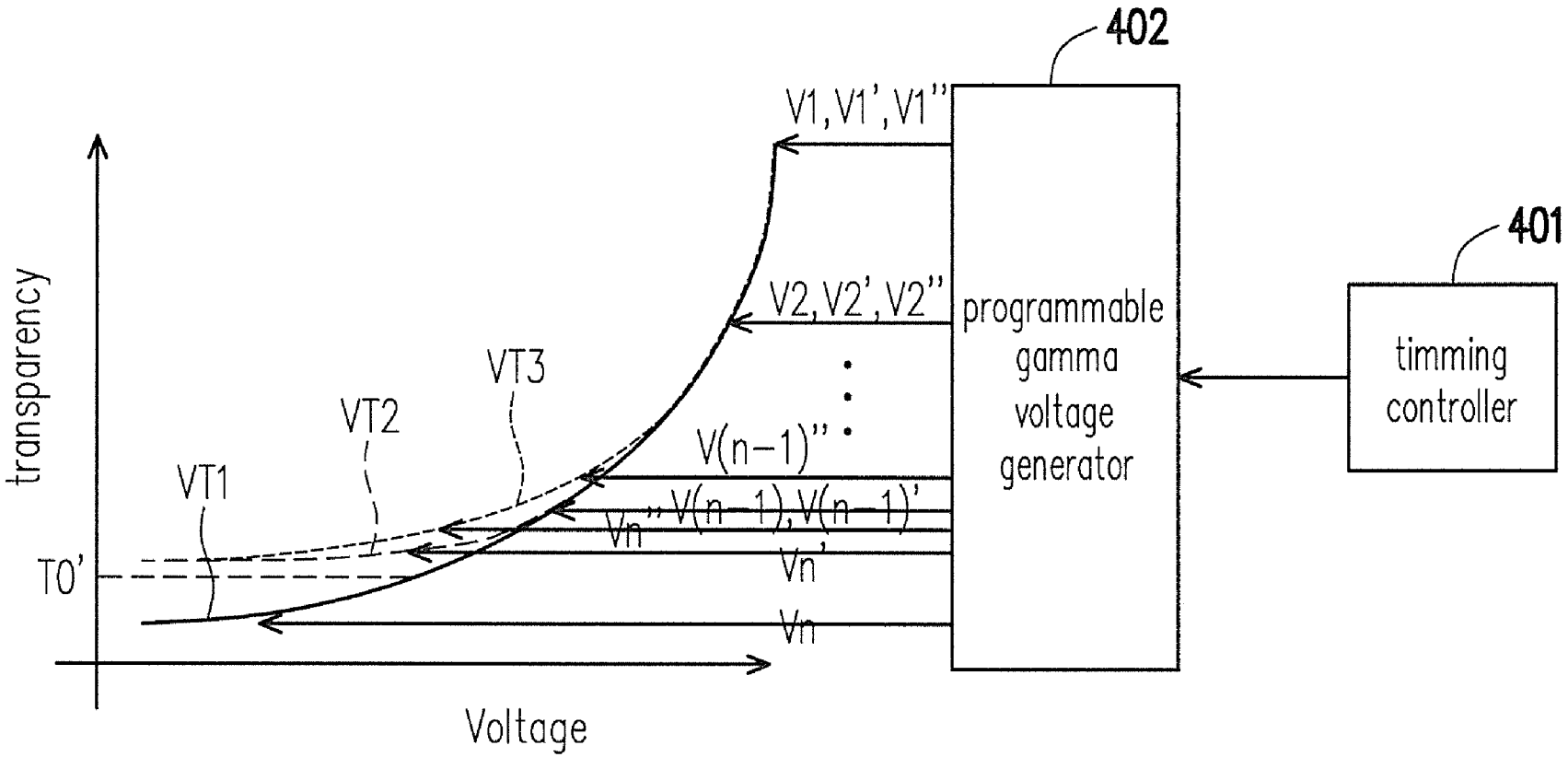
FIG. 4 shows a diagram of a plurality of the V-T curves according to an embodiment of the present invention.

FIG. 4 shows a diagram of a plurality of V-T curves according to an embodiment of the present invention. Referring to FIG. 4, the plural V-T curves may be provided by the resistor string as illustrated in FIG. 3A or a programmable gamma voltage generator 402 as illustrated in FIG. 4. There are three V-T curves, VT1, VT2 and VT3 illustrated in FIG. 4, but more V-T curves may be used so that the present invention is not limited thereto. The V-T curve VT3 is determined by the gamma voltages V1" through Vn". Compared with the V-T curve VT2, the gamma voltages V(n−1)" and Vn" corresponding to the gray levels are different to the gamma voltages V(n−1)' and Vn' corresponding to the same gray levels. Similarly, the display apparatus determines which V-T curves to be applied to display images based on the display mode and/or the ambient light intensity. The programmable gamma voltage generator 402 is controlled by the timing controller 401 of the display apparatus for generating the gamma voltages based on the selected V-T curve.

Figure 5:
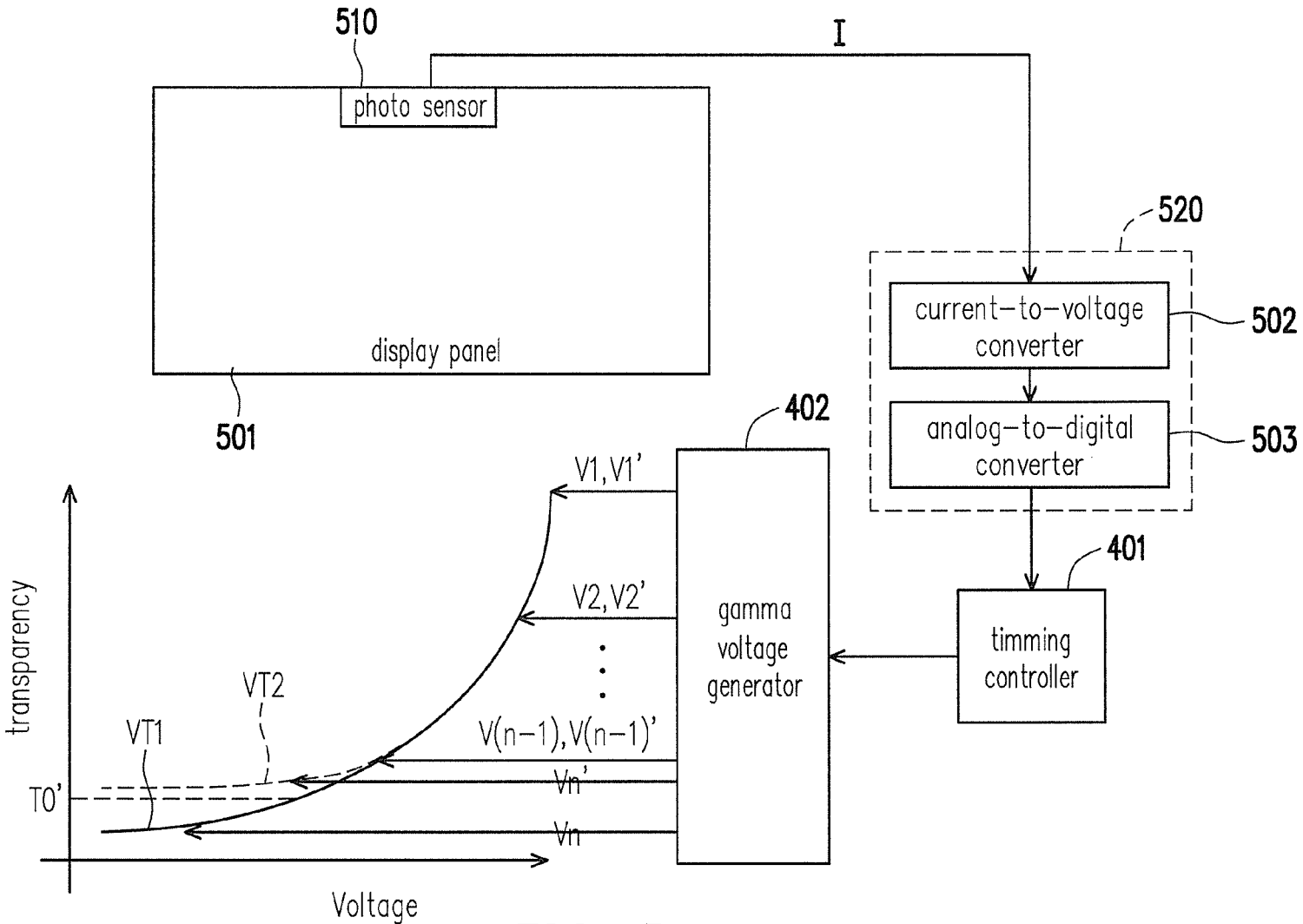
FIG. 5 shows a block diagram of a transreflective display apparatus according to an embodiment of the present invention.

FIG. 5 shows a block diagram of a transreflective display apparatus according to an embodiment of the present invention. The display apparatus includes a display panel 501, a backlight module, an ambient light detector, a timing controller 401 and a programmable gamma voltage generator 402. The ambient light detector includes a photo sensor 510 and a light controller 520. The photo sensor 510 detects the ambient light to output the detection current I to the light controller 520. The light controller 520 includes a current-to-voltage converter 502 and an analog-to-digital converter 503 for converting the detection current I into a detection signal and outputting the detection signal to the timing controller 401. The ambient light detector then determines the display mode of the display apparatus, which is either the transmissive mode or the reflective mode, by the intensity of the ambient light. When the display mode is the transmissive mode, the backlight module would provide a backlight to the display panel, else the backlight module is turned off. The timing controller 401 selects one of the V-T curves based on the display mode and/or the intensity of the ambient light. The timing controller 401 receives the intensity of the ambient light and thereby controls the programmable gamma voltage generator 402 to generate a set of gamma voltages corresponding to the selected V-T curve. In another embodiment, the light controller 520 and the timing controller 401 can be integrated into an integrated circuit (IC).

In summary, the transreflective display apparatus can determine the display mode to be the transmissive mode or the reflective mode according to the ambient light intensity detected by the ambient light controller. When the display apparatus is in the transmissive mode, the darker pixels having the lower gray levels may not be displayed distinguishably, so that a plurality of V-T curves for different display modes are provided in the said embodiment, and a proper one among them can be selected according to the display mode and the ambient light intensity to drive the display panel. With regard to the V-T curve of the transmissive mode, the gamma voltages provided by referring the V-T curve of the transmissive mode can drive the pixels at the transparencies which are above the critical transparency associated with the ambient light intensity, and have small difference each other. As a result, the darker pixels can be displayed distinguishably and the display quality can be enhanced.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A driving method for a transreflective display apparatus, the driving method comprising:

providing a plurality of voltage-to-transparency (V-T) curves;

detecting an ambient light intensity of the display apparatus;

determining a display mode according to the ambient light intensity, wherein the display mode is either a transmissive mode or a reflective mode; and selecting one of the V-T curves to drive the display apparatus based on the display mode and the ambient light intensity, wherein a gamma voltage corresponding to a low gray level of the transmissive mode V-T curve is larger than a gamma voltage corresponding the same gray level of the reflective mode V-T curve.

2. The driving method as claimed in claim 1, wherein the V-T curves include a reflective mode V-T curve and a transmissive mode V-T curve.

3. The driving method as claimed in claim 2, wherein in the selecting step, the transmissive mode V-T curve is selected if the display mode is the transmissive mode.

4. The driving method as claimed in claim 2, wherein in the selecting step, the transmissive mode V-T curve is selected if the display mode is the transmissive mode, and there exists some ambient light.

5. The driving method as claimed in claim 2, wherein in the selecting step, the transmissive mode V-T curve is selected if the display mode is the transmissive mode, and the ambient light intensity is larger than a low threshold.

6. The driving method as claimed in claim 2, wherein a gamma voltage corresponding to a high gray level of the transmissive mode V-T curve is substantially equal to a gamma voltage corresponding the same gray level of the reflective mode V-T curve.

7. The driving method as claimed in claim 1, wherein each V-T curve is generated by a set of gamma voltages.

8. The driving method as claimed in claim 7, wherein the set of gamma voltages is generated by a resistor string.

9. The driving method as claimed in claim 7, wherein the set of gamma voltages is generated by a programmable gamma voltage generator.

10. A transreflective display apparatus, comprising:

a display panel, for displaying an image;

an ambient light detector, coupled to the display panel for detecting an ambient light intensity of the display apparatus, and thereby determining a display mode of the display apparatus according to the ambient light intensity, wherein the display mode is either a transmissive mode or a reflective mode;

a backlight module, for providing a backlight when the display mode is the transmissive mode;

a timing controller, coupled to the ambient light detector for selecting one of a plurality of voltage-to-transparency (V-T) curves according to the display mode and the ambient light intensity; and a gamma voltage generator, coupled to the timing controller and controlled by the timing controller for generating a plurality of gamma voltages based on the selected V-T curve, wherein one of the gamma voltages corresponding to a low gray level of the transmissive mode V-T curve is larger than one of the gamma voltages corresponding the same gray level of the reflective mode V-T curve.

11. The display apparatus as claimed in claim 10, wherein the ambient light detector comprises:

a photo sensor, for detecting the ambient light intensity of the display apparatus to output an electronic signal; and a light controller, coupled to the photo sensor, for receiving the electronic signal, and converting the electronic signal into a detection signal with digital form, wherein the ambient light controller determines the display mode according to the detection signal.

12. The display apparatus as claimed in claim 10, wherein the V-T curves includes a reflective mode V-T curve and a transmissive mode V-T curve.

13. The display apparatus as claimed in claim 12, wherein the timing controller selects the transmissive mode V-T curve if the display mode is the transmissive mode.

14. The display apparatus as claimed in claim 12, wherein the timing controller selects the transmissive mode V-T curve if the display mode is the transmissive mode, and there exists some ambient light.

15. The display apparatus as claimed in claim 12, wherein the timing controller selects the transmissive mode V-T curve if the display mode is the transmissive mode, and the ambient light intensity is larger than a low threshold.

16. The display apparatus as claimed in claim 12, wherein one of the gamma voltages corresponding to a high gray level of the transmissive mode V-T curve is substantially equal to one of the gamma voltages corresponding the same gray level of the reflective mode V-T curve.

* * * * *